United States Patent [19]

Kanao

[11] 4,166,724

[45] Sep. 4, 1979

[54] FUEL COMPOSITION

[76] Inventor: Mitsuhiro Kanao, 2156-14 Yakeyamacho, Kure-shi, Hiroshima-ken, Japan

[21] Appl. No.: 799,613

[22] Filed: May 23, 1977

Related U.S. Application Data

[63] Continuation of Ser. No. 564,183, Apr. 1, 1975, abandoned, which is a continuation of Ser. No. 447,190, Mar. 1, 1974, abandoned, which is a continuation of Ser. No. 292,837, Sep. 27, 1972, abandoned.

[30] Foreign Application Priority Data

Oct. 8, 1971 [JP] Japan ..... 46-79226

[51] Int. Cl.[2] ..... C10L 1/22

[52] U.S. Cl. ..... 44/56

[58] Field of Search ..... 44/56, 52

[56] References Cited

U.S. PATENT DOCUMENTS

| | | | |
|---|---|---|---|
| 1,589,885 | 6/1926 | Howard | 44/56 |
| 1,752,724 | 4/1930 | Bourie | 44/56 |

*Primary Examiner*—Winston A. Douglas
*Assistant Examiner*—Y. Harris-Smith
*Attorney, Agent, or Firm*—William Anthony Drucker

[57] ABSTRACT

An improved gasoline or light oil fuel for internal combustion engines has an additive comprising ammonia and methyl alcohol in proportions selected to provide reduction or elimination in the exhaust gases of nitrogen oxides, hydrocarbons, and carbon dioxide.

1 Claim, 4 Drawing Figures

Figure 1:
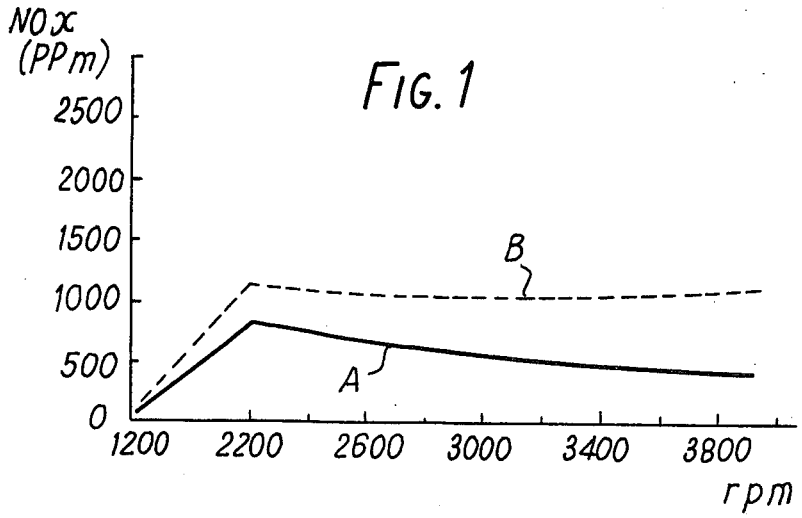

HC mg/l
8
7
6
5
4
3
2
1
0
B
A
1200
2200
2600
3000
3400
3800
rpm

HP
8·0
7·0
6·0
5·0
4·0
A
B
20
1·8
1·6
1·4
1·2
1·0
0·8
0·6
0·4
0·2
l/h
1200
2200
2600
3000
3400
3800
rpm

FUEL COMPOSITION

This is a continuation of application Ser. No. 564,183, now abandoned filed Apr. 1, 1975, which is a continuation of application Ser. No. 447,190, now abandoned filed Mar. 1, 1974 which is a continuation-in-part of Ser. No. 292,837, filed Sept. 27, 1972 now abandoned.

The object of the present invention is to provide an improved gasoline, or light oil fuel, with which there is obtained a relatively purified exhaust gas, in that the quantity of poisonous oxides generated by combustion is decreased. There are already known anti-knock additives for such fuels, e.g. tetraethyl-lead, aniline, ethylene dibromide, ethylene dichloride, xylene, toluene, and benzene. It is also known that ethyl nitrate, amyl nitrate and compounds having an $NO_3$ radical or a $NO_2$ radical are effective as an ignition accelerant for a diesel engine.

Further, it is known to add a barium to light oil as an inhibitor of smoke exhausted from a diesel engine so that the firing temperature of soot can be lowered at the last stage of combustion so as to decrease the exhausted amount of smoke. However, these additives are, in every respect, a combustion retarder or accelerator, or a black smoke inhibitor, but not an inhibitor of generation of poisonous oxides.

U.S. Pat. No. 1,589,885 HOWARD discloses a motor fuel containing alcohol and ammonia, utilised for the purpose of eliminating knocking, but does not suggest that such additives may be used for the purpose of reducing or eliminating the nitrogen oxide, hydrocarbon and carbon monoxide content of exhaust gas, and specifically does not disclose the relative proportions of the respective constituents in the additive, nor the relative proportion of additive to fuel required to obtain the novel and surprising results of the present invention.

According to the present invention a fuel, for an internal combustion engine, adapted to avoid the presence of nitrogen oxide, hydrocarbons, and carbon monoxide in the exhaust gas, comprises a fuel selected from the group consisting of gasoline and light oil having therein an additive mixed in the proportion of 10 liters of the fuel to about 3 to about 5 milliliters of the additive, said additive comprising a mixture of about 25 to about 16% of liquefied ammonia and about 85% to about 84% of methyl alcohol.

In order to decrease the generation of nitrogen oxides in combustion, there may be considered two methods, namely: (i) prevention of oxidation of nitrogen, and (ii) decomposition of generated nitrogen oxides.

If nitrogen oxides are generated simultaneously $$N_2+\tfrac{1}{2}O_2=N_2O-19.5\text{ Kcal}$$

$$\tfrac{1}{2}N_2+2/2O_2=NO-21.6\text{ Kcal}$$

$$\tfrac{1}{2}N_2+O_2=NO_2-8.1\text{ Kcal}$$

Further, when intermittent combustion is performed under high pressure in an enclosed chamber such as that of an internal combustion engine, it may be presumed that $N_2O$ is generated in a considerably large amount. However, assuming that $N_2O$ is promptly oxidized to be $NO_x$, the detected amount of $N_2O$ is very little in the exhaust gas discharged into the atmosphere.

$$N_2O+\tfrac{1}{2}O_2=2NO$$

$$N_2O+O_2=2NO_2$$

If nitrous oxide is first disposed of, there may be obtained a decrease of the amount of $NO_x$ successively generated. Accordingly, it is important to decompose $N_2O$.

The thermal dissociation of water molecules in fuels is $$2H_2O\rightarrow 2H_2+O_2$$

$$2H_2O+O_2\rightarrow 4OH$$

Then, $N_2O+H_2=N_2+H_2O=77.5$ Kcal.

Further, the mixture of nitrous oxide and ammonia is exploded by ignition.

$$3N_2O+2NH_3=4N_2+3H_2O+210\text{ Kcal.}$$

As a solvent for $NH_3$ there may be used alcohols and benzene $C_6H_6$. The solute may be $NH_3$, amines, ammonium carbonate $(NH_4)_2CO_3$ or 1.3-butadiene. A bad smell, and spontaneous evaporation may be caused by addition of the above.

Methyl alcohol can absorb ammonia very well. It can contain 40% of ammonia by weight at 10° C. and at a pressure of one atmosphere. Accordingly, it is quite favourable as an additive.

$NH_3$ may be added, from the start, by bleeding it directly into petroleum fuels at room temperature under normal pressure or under high pressure. Alternatively, it may be first dissolved in a suitable solvent, and then added directly in a different form without being mixed in the fuels.

The purification of CO and HmCn will now be examined, referring to the examples. Carbon monoxide is oxidized with oxygen from manganese dioxide to become carbon dioxide, and manganese dioxide becomes the lower oxide. Namely:

$$MnO_2+CO\rightarrow MnO+CO_2$$

On the other hand, MnO is again oxidized with oxygen in the gaseous phase (CO), to become $MnO_2$. Thus, reduction and oxidization are alternately performed on the surface of a catalyser at the time of reaction. Therefore, $$MnO+\tfrac{1}{2}O_2\rightarrow MnO_2$$

It is well known that the $MnO_2$ catalyser has a catalytic function which may continue its activity for many hours.

If there is a large amount of gas such as CO in an even highly efficient internal combustion engine, it is difficult to burn it fully because the gas temperature is low due to adiabatic combustion and cooling near the wall face of the cylinder. As a means of overcoming this difficulty, a catalyst may be added to lubricating oil. If, say, $MnO_2$ is added, the catalyst applied thinly on the wall of parts sliding on each other. However, it is necessary to take account of such problems as poisoning of the catalyst due to impurities of the reaction gas, damage to the wall face due to crystallization of oxides, and pulverization of the catalyst.

The water molecule of the fuel becomes a catalyst so that it can serve as a means for purifying the exhaust gas. However, it is also necessary to consider other metallic catalysts which are not separated from the fuel.

In an embodiment of the invention, ammonia was used as an agent for decomposing nitrogen oxides. A simple comparative test was carried out between the fuel, having ammonia added, and the same fuel, without ammonia added.

In order to add ammonia into 10 liters of gasoline, 250 cc of strong liquid ammonia was put in a suitable amount of gasoline and fully mixed. The mixture was left for 24 hours. It was used after the condensed water had been taken away. A simple comparative test was carried out between the $NH_3$-blended gasoline and the non-blended gasoline, by use in an engine (Type: EA61 type fourcycle, horizontally opposed piston four cylinders, bore 76 mm, stroke 60 mm, total displacement 1088 cc, compression ratio 9:1, maximum power bzPS/6000 r.p.m., maximum torque 8.7 Kg/m - 3200 r.p.m., compressive pressure 12.5 Kg/cm$^2$ - 350 r.p.m., cooling method water-cooled system) for a motor vehicle known commercially as "Subaru 1000". The result was as shown in the table given below.

The method of analysis of the nitrogen oxides was the naphthyl-ethylene-di-amine method.

The engine was driven at a constant velocity and with no load.

The test was carried out on Sept. 22, 1971, with atmospheric pressure at 10,186 millibar, and air temperature at 28° C.

| Speed | Gasoline | Gasoline + $NH_3$ |
|---|---|---|
| idling | 10 | 10 |
| 6000 | 680 | 180 |
| 8000 | 520 | 460 |

-continued

| Speed | Gasoline | Gasoline + $NH_3$ |
|---|---|---|
| r.p.m. | ppm of NO + $NO_2$ | ppm of NO + $NO_2$ |

Figure 2:
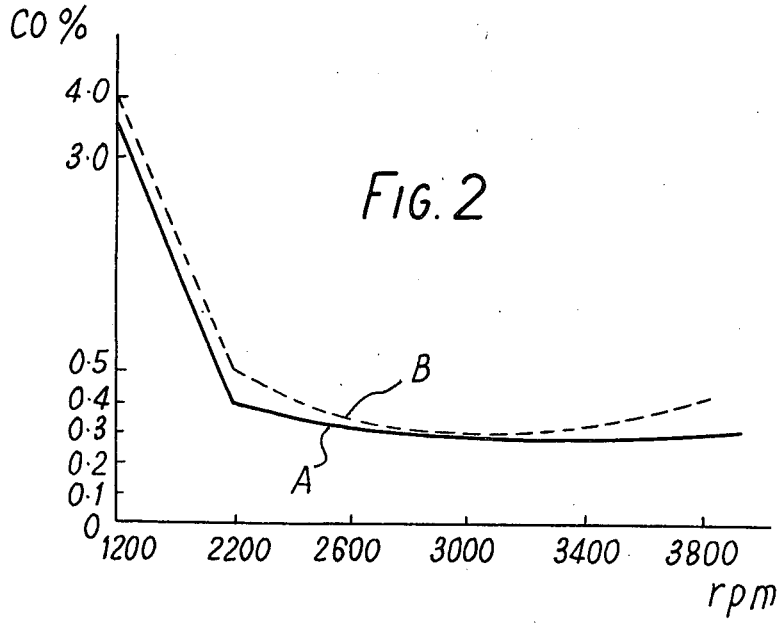
Figure 3:
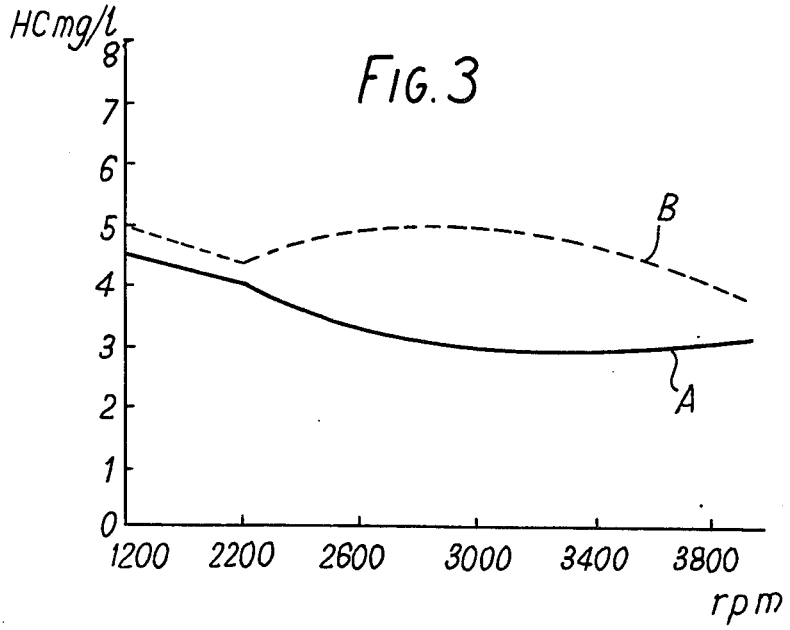
Figure 4:
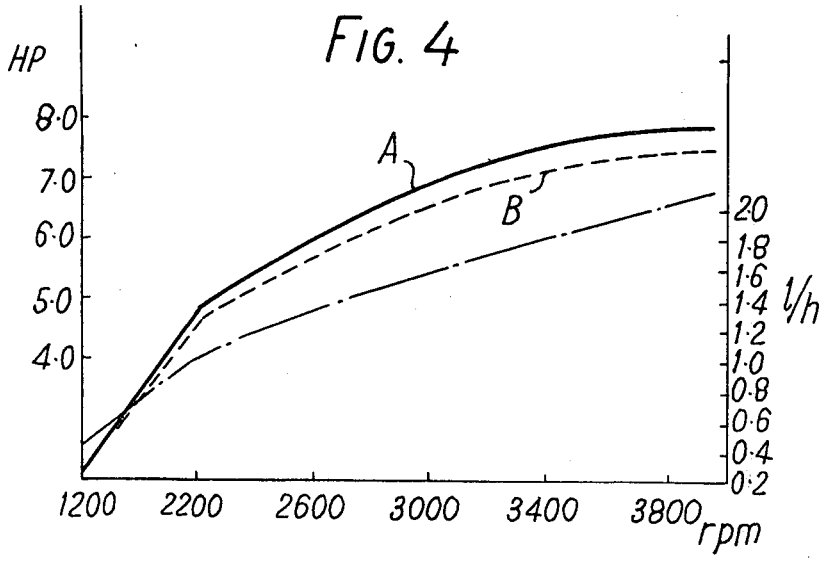

The invention is hereinafter further described with reference to the figures of the accompanying drawing, wherein FIGS. 1 to 4 are graphs illustrating comparisons between the exhaust gas content and the horse power obtained utilising the improved fuel of the present invention, and a conventional fuel.

In these drawings, the full line A relates in each case to the improved fuel of the present invention, and the broken line B relates in each case to the conventional fuel.

As can be clearly seen in these graphs, the content of nitrogen oxides, carbon monoxide and hydrocarbons in the exhaust of the fuel of the present invention is lower than that in the exhaust gas of the conventional fuel.

It is to be noted that the content of nitrogen oxides is remarkably less. Further, the improved fuel of the present invention produces more horse power than the conventional fuel.

The improved fuel represented by the full line A was prepared by mixing 15% of liquefied ammonia with 85% of methyl alcohol under agitation, and then adding about 5 milliliters of the resultant mixture to ten liters of gasoline.

I claim:

1. A fuel, for an internal combustion engine, adapted to avoid the presence of nitrogen oxide, hydrocarbons, and carbon monoxide in the exhaust gas, comprising a fuel selected from the group consisting of gasoline and light oil having therein an additive mixed in the proportion of 10 liters of the fuel to about 3 to about 5 milliliters of the additive, said additive comprising a mixture of about 15 to about 16% of liquefied ammonia and about 85% to about 84% of methyl alcohol.

* * * * *